US006289969B1

(12) United States Patent
Outten et al.

(10) Patent No.: US 6,289,969 B1
(45) Date of Patent: Sep. 18, 2001

(54) METAL CASTING

(75) Inventors: John F. Outten, N. Ridgeville; Robert S. Sisetski, N. Olmsted, both of OH (US)

(73) Assignee: Foseco International Limited, Swindon (GB)

( * ) Notice: Subject to any disclaimer, the term of this patent is extended or adjusted under 35 U.S.C. 154(b) by 0 days.

(21) Appl. No.: 09/282,189

(22) Filed: Mar. 31, 1999

Related U.S. Application Data

(60) Provisional application No. 60/081,047, filed on Apr. 8, 1998.

(51) Int. Cl.[7] ..... B22D 23/00; B22D 35/00; B22C 9/08

(52) U.S. Cl. ..... 164/134; 164/359; 164/360; 164/361; 164/362; 249/133; 249/117; 210/510.1; 266/227

(58) Field of Search ..... 164/134, 358, 164/359, 360, 361, 362; 249/135, 117; 210/510.1; 266/227

(56) References Cited

U.S. PATENT DOCUMENTS

| | | | | |
|---|---|---|---|---|
| 1,657,952 | * | 1/1928 | Zoda | 164/358 |
| 4,913,218 | * | 4/1990 | Seidinger | 164/358 |
| 4,928,746 | | 5/1990 | Butler et al. . | |
| 4,961,460 | * | 10/1990 | Butler | 164/134 |
| 5,896,912 | * | 4/1999 | Monroe et al. | 164/134 |

FOREIGN PATENT DOCUMENTS

| | | | | |
|---|---|---|---|---|
| 668371 | * | 12/1988 | (CH) | 164/134 |
| 3340417 | * | 5/1985 | (DE) | 164/134 |
| 63-224854 | * | 9/1988 | (JP) | 164/134 |
| 4-322707 | * | 11/1992 | (JP) | 210/510.1 |

* cited by examiner

*Primary Examiner*—Nam Nguyen
*Assistant Examiner*—I.-H. Lin
(74) *Attorney, Agent, or Firm*—Nixon & Vanderhye P.C.

(57) ABSTRACT

A filter unit for use in metal casting including a filter adapter, a filter adapter per se, and a mold for use in metal casting utilizing the filter unit, as well as a method of producing a metal casting, facilitate or practice direct pouring in a manner which provides for greater flexibility, being applicable to a wider range of castings. The apparatus elements and method are particularly suitable for the manufacturing of castings of relatively high modulus and low pour weight, and for the manufacture of high volume castings of low modulus. The mold includes a mold cavity and a sprue, a filter unit located in the sprue, and the filter unit comprising an adapter of refractory material having one or more ledges o10 for mounting a filter, and a filter (e.g. ceramic foam filter) supported by one of the ledges. The size of the filter and adapter may be changed to suit the metal pour weight and volume parameters of the metal casting to be produced, and the method is practiced by direct pour of metal through the filter. A feeder sleeve may be located on the filter adapter, or the filter adapter may be mounted in the feeder sleeve.

23 Claims, 3 Drawing Sheets

71
81
80
w
78
82
77
72
82

93
94
91
96
95
90
92
92
89

METAL CASTING

CROSS-REFERENCE TO RELATED APPLICATION

This application is based upon provisional application ser. No. 60/081,047 filed Apr. 8, 1998.

BACKGROUND AND SUMMARY OF THE INVENTION

This invention relates to metal casting using a filter and is particularly suited to metal casting using direct pour methods, such as shown in U.S. Pat. Nos. 4,928,746 and 4,961,460 (incorporated by reference herein) although it is not limited to direct pour methods.

Conventionally molds such as sand molds or metal dies for casting molten metal have a mold cavity for producing the desired casting and a running system, usually comprising or consisting of a sprue, one or more runner bars and one or more in gates, and possibly one or more feeder cavities located above or at the side of the mold cavity. Because cast metals shrink during solidification, it is common practice to surround a feeder head with an exothermic and/or a thermally insulating feeder sleeve to retain the feeder head metal in molten state for as long as possible so as to improve the feeding effect and to enable the feeder head volume to be reduced to a minimum. (As used herein the terms "sprue" or "sprues" mean any passage or passages which is or are used to provide essentially the sole means of entry of molten metal into the mold cavity.)

The use of a well designed running system can reduce turbulence as well as ensuring that the mold cavity is filled satisfactorily but can entail the use of significantly more metal than is required for the production of the casting itself. It is not uncommon for the total weight of a casting running and feeder system to be up to about 50% of the total weight of a small metal casting.

The direct pour system and method was devised to overcome this problem and is described in European patent no. 0327226 and in U.S. Pat. Nos. 4,928,746 and 4,961,460. In those patents there is described a mold for metal casting having a mold cavity, a sprue communicating directly with the mold cavity, and—located in the sprue—a sleeve of refractory material having a filter fixed therein, the filter typically being a ceramic foam filter and located adjacent the lower end of the sleeve.

Also described in the aforesaid patents is a sleeve of refractory material having a filter fixed therein for use in a mold for casting metal as described in the immediately preceding paragraph, the filter being of a ceramic foam and located adjacent the lower end of the sleeve.

By utilizing the direct pour method of the aforesaid patents, the need to use a running system can be substantially or completely eliminated.

It has now been found that the invention of the aforesaid patents can be improved to provide a more flexible system that can be applied to a wider range of castings and is particularly suitable for the manufacture of castings of relatively high modulus, i.e. the ratio of volume to cooling surface, and low pour weight, and conversely for the manufacture of high volume castings of low modulus, although it will be appreciated that the invention is not limited to such castings.

Accordingly, in one aspect, the present invention provides a filter unit for use in metal casting, the unit comprising an adapter formed of refractory material, the adapter having one or more locations to receive a filter, so that the size of filter and adapter used may be selected to suit the metal pour weight and volume parameters of the casting, and a, filter positioned at said location or one of said locations.

In another aspect the invention provides an adapter as defined in the immediately preceding paragraph, preferably with a plurality of ledges.

In a yet further aspect the invention provides a sprue for metal casting, the sprue communicating directly or indirectly with a mold cavity, and located in the sprue a unit containing a filter as described in the two immediately preceding paragraphs.

Where the adapter has two or more locations to receive a filter, it is preferred that each location be designed to receive a filter of a size different from the other location(s).

The filter is preferably a foam filter, especially a ceramic foam filter, and will for convenience be more specifically described below with reference to ceramic foam filters. It will be appreciated, however, that it is not intended to be so limited, and other filters are also suitable as long as they effectively perform their filtering function in this environment.

The adapter may be used with or without a sleeve and in the former case may be shaped, e.g. tapered, to be a fit inside the correspondingly shaped sleeve, e.g. towards the lower end of the sleeve.

Where the adapter with its filter is used in a sprue as described above, the filter can be supported at all its sides, whereas in conventional practice it is not possible to support at all four sides due to the number of exits from beneath the filter leading to the mold cavity. To prevent risk of metal bypassing the filter, it is not possible to utilize the whole of the upper face of the filter in conventional practice.

Most conveniently, the location(s) for a filter is/are formed in the adapter as one or more internal ledges. Each ledge is preferably a continuous ledge extending completely around the internal perimeter of the adapter and provides a secure location for a filter as well as preventing metal bypass.

As indicated above, each ledge providing a single location for a filter is designed to accommodate a filter of size different from that to be accommodated by any other ledge. This can very conveniently be provided by forming the ledge or ledges as one or more steps on the internal perimeter of the adapter.

If desired, additional securing means may be provided at the filter locations, e.g. in the form of vertically extending and tapering projections on the inside perimeter of the adapter.

Where used, the sleeve may be designed to sit on top of the adapter, although it may be preferred to arrange for the adapter to sit inside the sleeve.

The outer surface of the adapter may be tapered in order that it may conveniently be fitted into a sprue or sleeve with the sprue or sleeve being correspondingly tapered to receive it. The direction of the taper will of course be determined by whether the unit is to be inserted into a preformed cavity from above or from below.

The unit is preferably located in a sprue so that its lower end is not in contact with the casting. This can be achieved by, for example, incorporating a ledge above the base of the sprue and seating the unit on the ledge.

The sleeve and the adapter may be made from the materials and in the manner described in the aforesaid patents. Thus they may be made from metals, ceramic materials, bonded particulate refractory materials such as silica sand and bonded refractory heat-insulating materials containing refractory fibers. For some applications the unit may also contain exothermic materials. It may be found advantageous in certain circumstances to make the adapter and sleeve of different materials.

Thus the adapter may be made in bonded refractory heat-insulating material and is made by dewatering onto a suitable former an aqueous slurry containing fibrous material and a binder and optionally particulate material, removing the product from the former, and then heating to remove water and to harden or cure the binder. Alternatively, the adapter may be made by other conventional techniques or means, e.g. shell molding or core shooting without the need for an oven to cure the binder.

For ease of manufacture the sleeve, where used, and adapter will usually be of substantially circular horizontal cross-section but that cross-section may be, for example, oval, oblong, square, or polygonal, to facilitate easier removal.

The ceramic foam filter may be made using well known methods of making ceramic foam, in which an organic foam, usually polyurethane foam, is impregnated with an aqueous slurry of ceramic material containing a binder, the impregnated foam is dried to remove water and the dried impregnated foam is fired to burn off the organic foam to produce a ceramic foam.

If desired the filter may be fixed af the chosen location in the adapter using an adhesive, the tapered projections referred to above, and/or any other convenient means.

As with the system described in the aforesaid patents, the present invention enables use of a mold with no running system apart from the sprue, but in addition to the mold cavity and the sprue the mold may also have one or more feeder cavities.

Additionally the present invention enables a wide range of casting modulus to be achieved from a single unit in which only the filter size need be changed. The unit enables larger filters to be used without the need for a sleeve, particularly where the use of a sleeve would be uneconomical because of its disproportionate size, and hence cost, necessitated by the size of the filter, since the adapter can be smaller and cheaper. This may, for example, be of particular value in the production of aluminum gravity diecastings.

The invention is particularly useful for the production of steel castings, especially of high modulus and low pour weight or, conversely, of low modulus and high pour weight, i.e. castings outside the conventional commensurate scope of filter and sleeve diameters. However, the invention can equally be used for other ferrous and non-ferrous castings, e.g. of aluminum, aluminum alloys, aluminum bronze, and magnesium, copper, zinc and their alloys.

The mold may be a sand mold prepared to conventional foundry practice or a permanent mold, such as a metal die, for producing castings by gravity diecasting or by low pressure diecasting.

When a casting requiring a feeder is produced using the unit of the invention, it is possible to locate the unit in the feeder cavity and to utilize the feeder as the sprue. In such applications it will be usual to use an adapter and/or sleeve which has exothermic and/or heat-insulating properties as well as being refractory in order to achieve satisfactory feeding of the casting.

A breaker core may be used, if desired, in the conventional manner or, if desired, the adapter of the invention may also be designed to act as a breaker core. Where a separate breaker core is used, it may be, for example, of the push fit type described in GB pat. no. 1597 832, the disclosure of which is hereby incorporated by reference herein Alternatively, where the adapter is designed to act as a breaker core, it may have a similar push fit design.

According to another aspect of the present invention a method of producing a metal casting is provided. The method comprises the steps of: (a) Providing a mold cavity having one or more sprues communicating with the mold cavity and providing substantially the sole entry of molten-metal for forming a metal casting into the mold cavity. (b) Locating an adapter of refractory material, capable of mounting a filter, at one or more sprues. (c) Optionally, locating the adapter in a sleeve, or a sleeve on the adapter. (d) Disposing a filter in contact with and supported by the adapter so that the filter is spaced from the surface of a metal casting to be produced. (e) Practicing steps (b)–(d) to select a size of filter and adapter to suit the metal pour weight and volume parameters of a metal casting to be produced. And, (f) pouring molten metal through the filter into the mold cavity to provide a smooth, substantially non-turbulent, flow of molten metal through the filter into the cavity, to produce a metal casting.

The method may also include the step of forming the mold of sand or metal, and providing one of the sprue and adapter with protrusions and engaging the other of the sprue and adapter with protrusions to hold the adapter in position in the sprue. Step (d) may be practiced by disposing a ceramic foam filter in contact with and supported by the adapter. Preferably, the adapter has a plurality of internal ledges each for receipt of a filter of a different size; and steps (d) and (e) are practiced to select the size of filter that corresponds to one of the ledges, and to place that filter into contact With, and mounted by, that ledge. Step (c) may be practiced to locate the sleeve on the adapter, or to locate the adapter in the sleeve, or the method may be practiced without a sleeve.

It is the primary object of the present invention to enhance a direct pour system and method by making it more flexible, including for use with a wider range of castings such as those of relatively high modulus and low pour weight, or for the manufacture of high volume castings of low modulus. This and other objects of the invention will become clear from an inspection of the detailed description of the invention and from the appended claims.

DETAILED DESCRIPTION OF THE DRAWINGS

Figure 1:
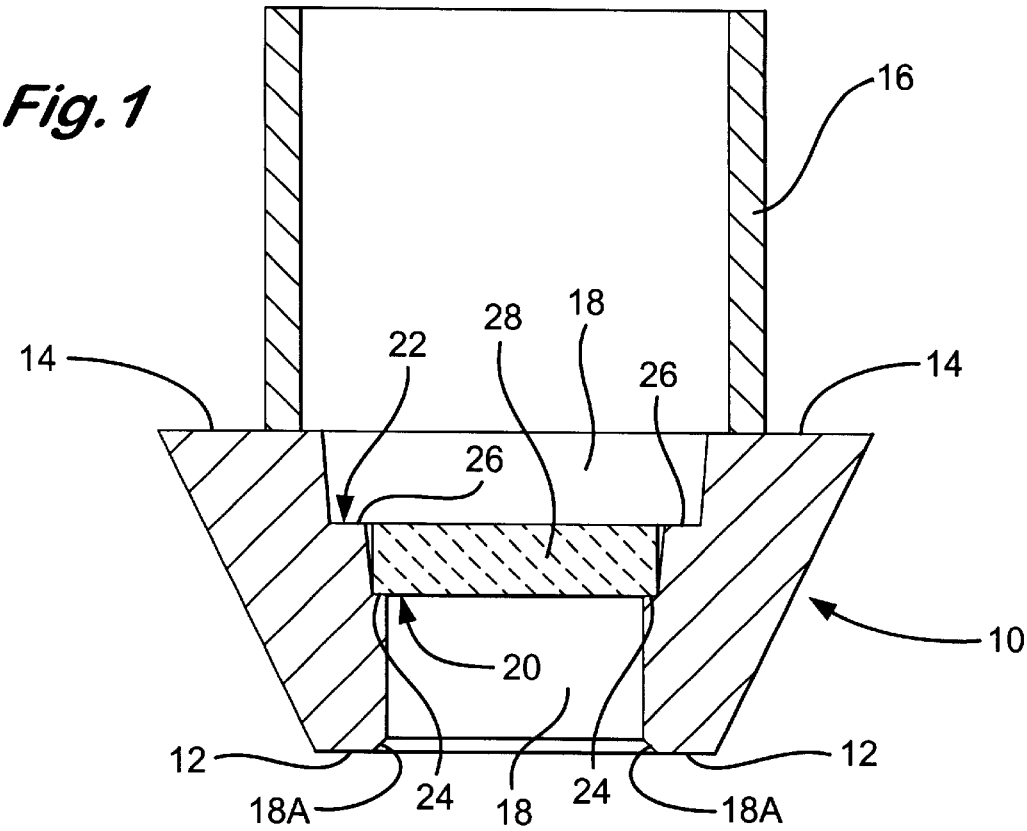
FIG. 1 is a vertical cross-section through a unit positioned beneath a sleeve according to a first embodiment of the invention.

In FIG. 1 an adapter 10 of substantially frusto-conical external shape has a substantially flat lower surface 12 at its narrower end. i.e. its lower end in use, and a substantially flat upper surface 14 at its opposite wider end, i.e. its upper end in use. A feeder sleeve 16 sits on surface 14 of the adapter 10.

The adapter 10 has a vertical through bore 18 which widens from its lower end via two stepped regions 20 and 22 to its upper end. The stepped regions 20, 22 provide two steps 24 and 26 on either of which a ceramic foam filter can be located. In the drawing a ceramic foam filter 28 is shown in position on the lower step 24. However, it will be appreciated that, if a larger filter were required, it could have been used instead of filter 28 and be located on the upper, larger step 26. (It will also be appreciated that a similar arrangement may be used in which the unit has only one step to accommodate a single size of filter, or more than two steps.)

The sloping substantially conical exterior surface 30 of the adapter 10 can be fitted into a correspondingly contoured conical entry (e.g. sprue) into a sprue of a casting mold where it can be firmly located. To aid this location and stability, the entrance to bore 18 of the adapter 10 at its lower end has a beveled edge 18A leading from surface 12 into the bore 18.

Figure 2:
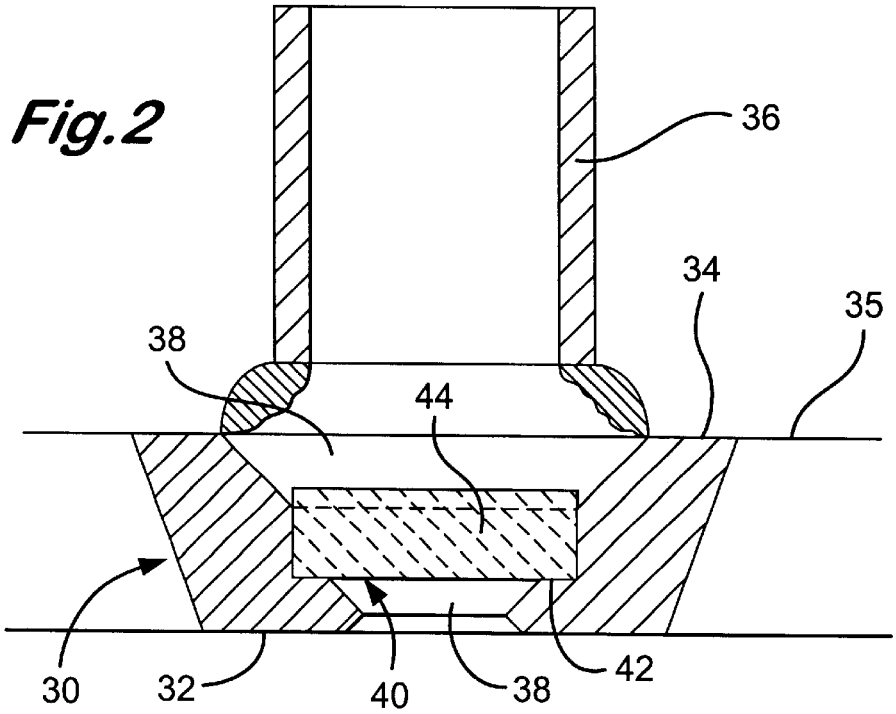
FIG. 2 is a similar view to that of FIG. 1 through a unit positioned beneath a sleeve according to a second embodiment of the invention.

In the immediately above described embodiment it will be appreciated that this is a "sleeve dominant" application, i.e. a relatively large sleeve 16 is used with a relatively smaller filter 28. FIG. 2 shows a "filter dominant" application i.e. a smaller sleeve 36 is used with a relatively larger filter 44. Here an adapter 30 has a similar substantially frusto-conical external shape to that of adapter 10 with a flat lower surface 32 and a flat upper surface 34. Upper surface 34 lies in the plane of the split line 35 of a mold. A sleeve or metal feeder 36 is positioned above and spaced away from adapter 30.

Adapter 30 has a vertical through-extending bore 38 which widens from its lower end via a single stepped region 40 to its upper end. The stepped region 40 provides a single step 42 on which is positioned the filter 44. (It will again be appreciated that the adapter 30 could, if desired, have two or more steps to locate filters of different sizes.)

As shown, the adapter 30 narrows externally to its lower end so that it can be filter into a correspondingly contoured cavity from above. It could equally have been designed with a reversed taper so that it widens to its lower end, so that it would be filtered into a correspondingly contoured cavity from below.

Figure 3:
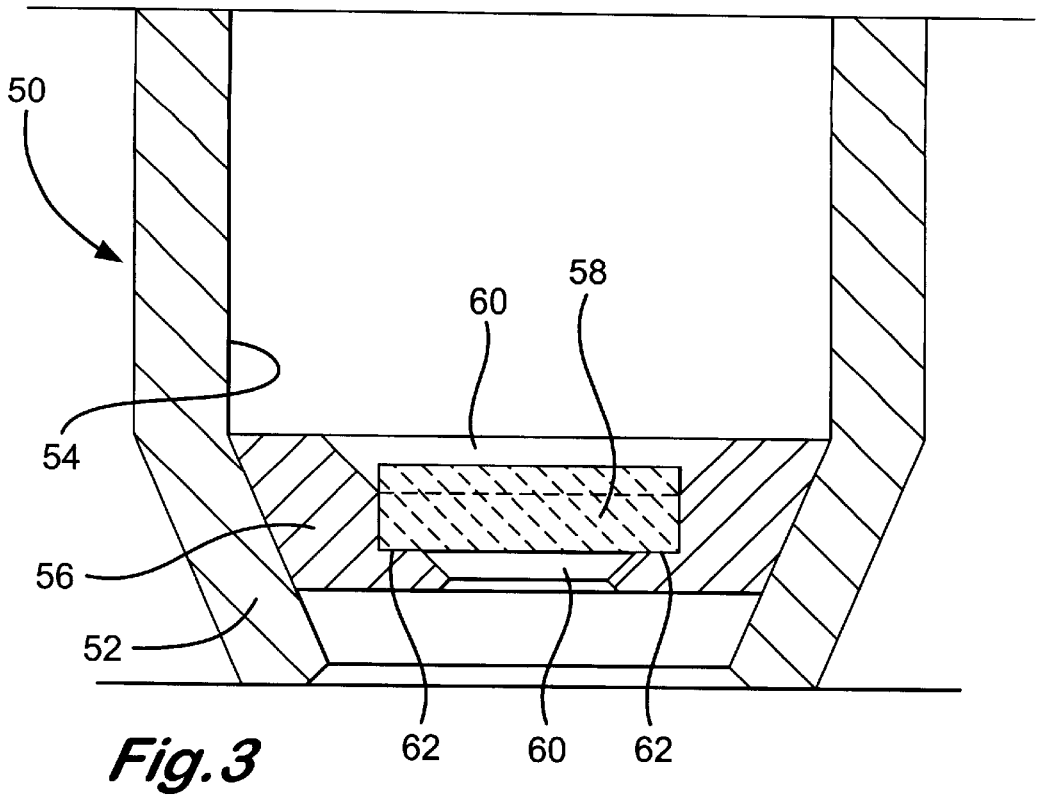
FIG. 3 is a similar view to that of FIG. 1 of a unit of the invention positioned inside the lower end of a sleeve.

In FIG. 3 is shown a sleeve 50 of the "neck down" type, i.e. it has a tapering portion 52 at its lower end beneath an upper portion 54 of substantially right cylindrical shape. A unit of the invention comprising an adapter 56 and a filter 58 is positioned in the sleeve 50 at its lower portion 52. Adapter 56 has an external taper substantially corresponding to that of the interior of sleeve portion 52 and can either sit loosely in the sleeve 50 or be adhered (e.g. with adhesive) in position. The adapter 56 has a through bore 60 with a single step 62 on which the filter 58 is positioned.

Figure 4:
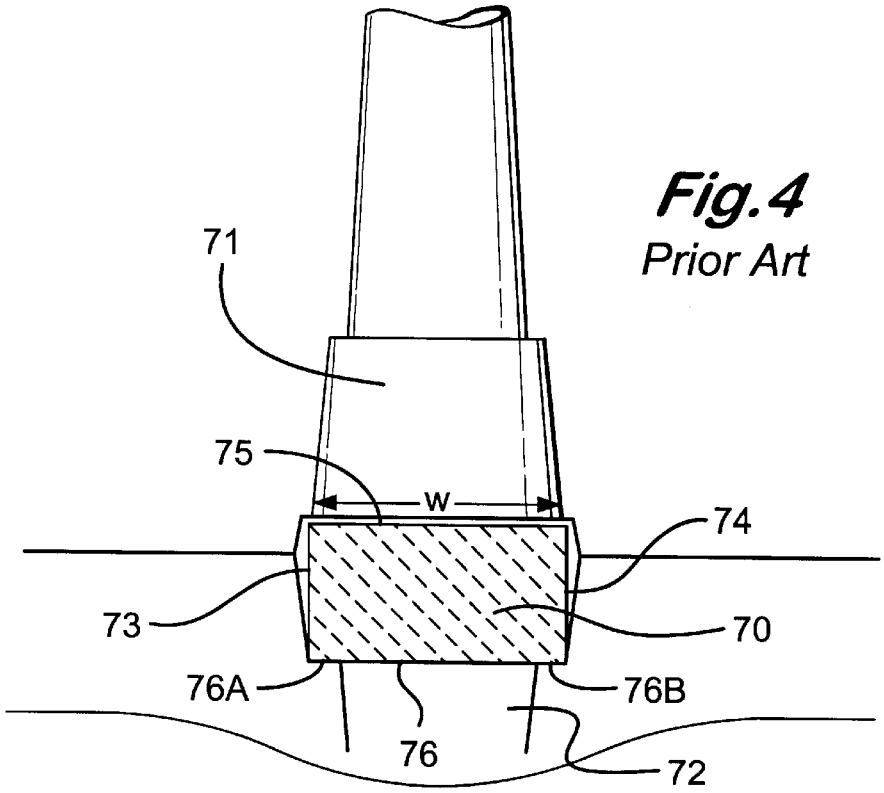
Fig.4 Prior Art
FIG. 4 is schematic representation of a conventional prior art, "in line" use of a filter, i.e. where the filter is positioned at the base of the sprue in the runner system.

In FIG. 4 a filter 70 sits in an appropriately shaped cavity at the base of a sprue 71 leading into a runner system the start of which is indicated at 72. This is a conventional arrangement. As can be seen, sides 73 and 74 of the filter 70 lie just outside the maximum width "w" of the sprue 71 immediately above the upper surface 75 of the filter 70. This means that the full upper surface area of the filter 70 cannot be utilized for filtration or there would be a possibility of molten metal bypassing the filter 70. Moreover, the filter 70 is seated at the edges 76A and 76B only of its lower surface 76 and this may represent as little as 40% of the maximum possible seating area depending on the number of exits for the sprue 71.

Figure 5:
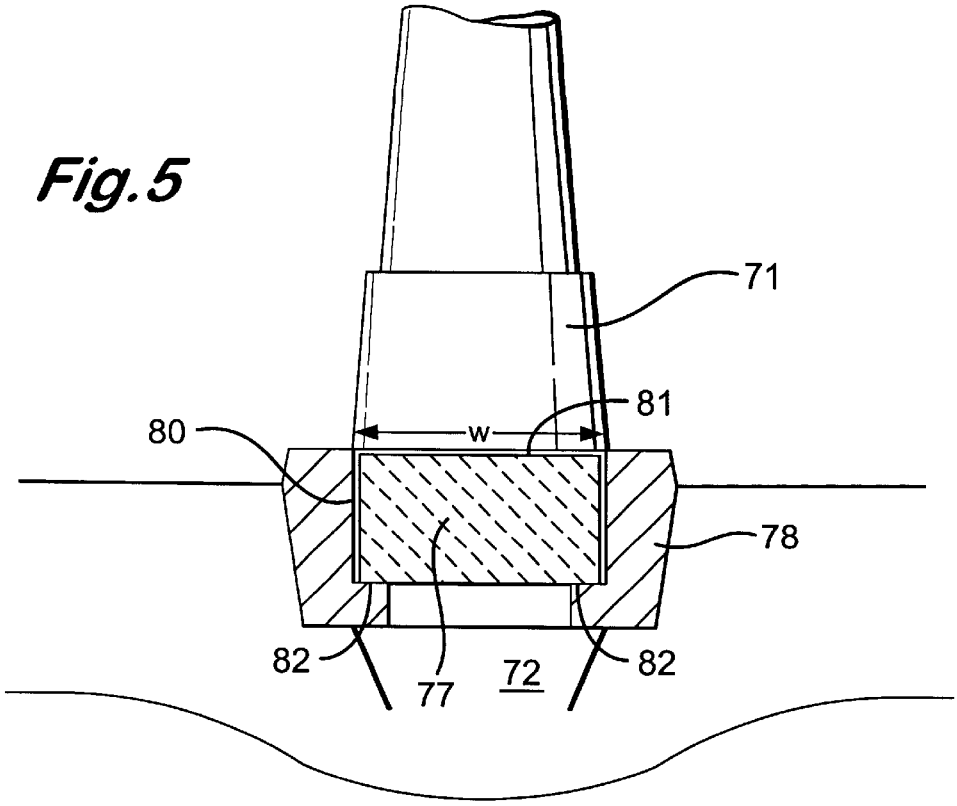
FIG. 5 is a similar representation of an "in line" arrangement like that of FIG. 4 only using a unit of the invention.

In FIG. 5 is shown an arrangement similar to that of FIG. 4 but using an adapter 78 of the invention. Here a similar sprue 71 and runner system 72 is provided with a filter 77 positioned in an adapter 78. Sides 79 and 80 of the filter 77 now lie within the maximum width "w" of the sprue immediately above the upper surface 81 of the filter 77. Now there is essentially no possibility of molten metal bypassing the filter and there is maximum utilization of the upper surface area of the filter. There is essentially 100% support of the seating area of the filter 77 in contact with step 82 of the adapter 78. Moreover, the adapter 78 may contain vertically extending tapered projections (not shown) on its inner surface to grip the sides of the filter 77 as mentioned above, thereby substantially preventing risk of the filter 77 floating upwardly during passage of the molten metal therethrough.

Figure 6:
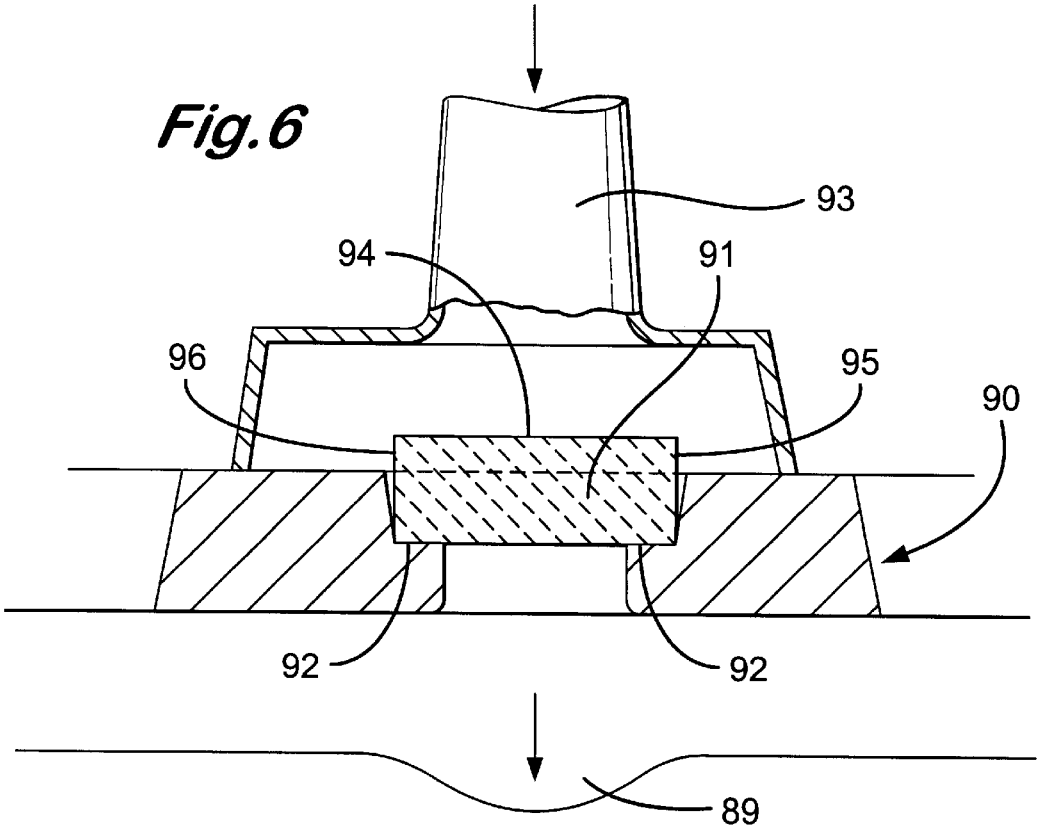
FIG. 6 is a schematic representation of a modification of the arrangement of FIG. 5.

In FIG. 6 an adapter unit 90 of the invention containing a filter 91 is constructed such that the filter 91 when positioned on step 92 in the adapter 90 extends above the top of the adapter 90. Thus molten metal passing through sprue 93 and then through the filter 91 utilizes a larger surface area of the filter 91 as it can flow not only through the upper surface 94 of the filter 91 but also through the exposed portions 95, 96 of the sides of the filter 91. Again the filter 91 is fully supported and there is essentially no risk of metal bypassing the filter 91.

In the practice of the exemplary method of producing a metal casting according to the invention, primarily with respect to the FIG. 6 embodiment but also with respect to the FIGS. 1–3 embodiments, there are the steps of: (a) Providing a mold cavity 89 having one or more sprues 93 communicating therewith and providing substantially the sole entry of molten metal for forming a metal casting into the mold cavity 89. (b) Locating an adapter 90 of refractory material, capable of mounting a filter, at one or more sprues 93 (e.g. in any of the positions illustrated in FIGS. 1 through 3, 5 and 6). (c) Optionally locating the adapter in a sleeve (see adapter 56 in sleeve 50 in FIG. 3), or a sleeve on the adapter (see sleeve 36 on adapter 30 in the FIG. 2 embodiment and sleeve 16 in adapter 10 is the FIG. 1 embodiment). (d) Disposing a filter (e.g. a ceramic foam filter) 91 in contact with and supported by the adapter 90 so that the filter 91 is spaced from the surface of the metal casting to be produced in the mold cavity 89. (e) Practicing steps (b) through (d) to select a size of filter 91 and adapter 90 to suit the metal pour weight and volume parameters of the metal casting to be produced. And, (f) pouring molten metal (e.g. aluminum, steel, copper, etc.) 97 through the filter 91 into the mold cavity 89 to provide a smooth, substantially non-turbulent, flow of molten metal through the filter 91 into the cavity 89, to produce a metal casting. Preferably the adapter has a plurality of internal steps (see adapter 10 in FIG. 1 and the steps 24, 26 thereof) each for supporting a different size filter, and step (e) is practiced by selecting the filter (e.g. 28 in FIG. 1) which cooperates with one of the steps (e.g. 24).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A filter unit for use in metal casting, the unit comprising:

a filter adapter formed of refractory material and having a tapered outer surface; said adapter having one or more locations which receive a filter, each location comprising an internal ledge, so that the size of the filter and adapter used may be selected to suit the metal pour weight and volume parameters of a metal casting to be produced;

a filter positioned at said location or one of said locations; and a feeder sleeve which is mounted on the filter adapter or in which the filter adapter is mounted.

2. A filter unit according to claim 1 wherein the or each ledge is a continuous ledge extending completely around an internal perimeter of the adapter.

3. A filter unit according to claim 1 wherein said filter adapter includes a plurality of said internal ledges in the form of a plurality of steps on an internal perimeter of the adapter.

4. A filter unit according to claim 1 wherein said filter adapter has a substantially frusto-conical external shape.

5. A filter unit according to claim 1 wherein said filter is a ceramic foam filter.

6. A filter unit according to claim 1 wherein said adapter is formed from a bonded refractory heat-insulating material.

7. A filter adapter for use in metal casting, comprising:

an adapter formed of refractory material, the adapter having a tapered outer surface and having two or more locations which receive a filter, each location comprising an internal ledge, so that the size of the filter used may be selected to suit the metal pour weight and volume parameters of the casting; and wherein each of said locations is constructed to receive a filter of a size different from the other location or locations.

8. A filter adapter according to claim 7 wherein each ledge is a continuous ledge extending completely around an internal perimeter of said adapter.

9. A filter adapter according to claim 7 wherein said filter adapter includes a plurality of said internal ledges in the form of a plurality of steps on an internal perimeter of the adapter.

10. A filter adapter according to claim 9 wherein said filter adapter has a substantially frusto-conical external shape.

11. A mold for use in metal casting, said mold comprising:

a mold cavity and a sprue communicating directly or indirectly with said mold cavity; and a filter unit located in said sprue, said filter unit comprising an adapter formed of refractory material and having a tapered outer surface, said adapter having two or more locations to receive a filter, each location comprising an internal ledge and constructed to receive a filter of a size different from the other location or locations, so that the size of filter and adapter used may be selected to suit the metal pour weight and volume parameters of a metal casting to be produced; and a filter positioned at said location or one of said locations.

12. A mold according to claim 11 wherein said filter adapter includes a plurality of said internal ledges in the form of a plurality of steps on an internal perimeter of said adapter.

13. A mold according to claim 11 devoid of a sleeve.

14. A mold according to claim 11 wherein said filter adapter has a substantially frusto-conical external shape.

15. A mold according to claim 11 wherein said filter is a ceramic foam filter.

16. A mold according to claim 11 further comprising a feeder sleeve located on said filter adapter.

17. A mold according to claim 11 further comprising a feeder sleeve, said filter adapter mounted in said feeder sleeve.

18. A method of producing a metal casting comprising the steps of:

(a) providing a mold cavity having one or more sprues communicating with the mold cavity and providing substantially the sole entry of molten metal for forming a metal casting into the mold cavity;

(b) locating an adapter of refractory material, capable of mounting a filter, at one or more sprues;

(c) locating the adapter in a sleeve, or a sleeve on the adapter;

(d) disposing a filter in contact with and supported by the adapter so that the filter is spaced from the surface of a metal casting to be produced;

(e) practicing steps (b)–(d) to select a size of filter and adapter to suit the metal pour weight and volume parameters of a metal casting to be produced; and (f) pouring molten metal through the filter into the mold cavity to provide a smooth, substantially non-turbulent, flow of molten metal through the filter into the cavity, to produce a metal casting.

19. A method according to claim 18, wherein step (d) is practiced by disposing a ceramic foam filter in contact with and supported by the adapter.

20. A method as recited in claim 18, wherein the adapter has a plurality of internal ledges each for receipt of a filter of a different size; and wherein steps (d) and (e) are practiced to select the size of filter that corresponds to one of the ledges, and to place that filter into contact with, and mounted by, that ledge.

21. A method as recited in claim 18, wherein the adapter has a tapered outer surface having a substantially frusto-conical portion, and wherein (c) is practiced by bringing the frusto-conical portion in contact with a cooperatively tapered internal portion of the sleeve.

22. A method as recited in claim 18, wherein step (c) is practiced by locating the adapter in the sleeve.

23. A method as recited in claim 18, wherein step (c) is practiced by locating the sleeve on the adapter.

* * * * *